United States Patent [19]

Sommer et al.

[11] 4,030,944

[45] June 21, 1977

[54] PRODUCTION OF ANNULAR PRODUCTS FROM CENTRIFUGALLY CAST STEEL STRUCTURES

[75] Inventors: Karel Sommer; Jiří Zdrazil; Milan Kubinek, all of Brno; Jarolim Bahna, Ilava; Stanislav Kyselica, Trencianske Teplice; František Habrovec; Jiří Škarek, both of Brno, all of Czechoslovakia

[73] Assignee: Ceskoslovenska akademie ved, Prague, Czechoslovakia

[22] Filed: Apr. 15, 1976

[21] Appl. No.: 677,427

[52] U.S. Cl. ..... 148/2; 148/12 R; 148/12.4

[51] Int. Cl.[2] ..... B22D 13/02; C21D 9/08

[58] Field of Search ..... 148/2, 12 R, 12.4; 164/114

[56] References Cited

UNITED STATES PATENTS

| | | | |
|---|---|---|---|
| 3,615,879 | 10/1971 | Herzog | 148/2 |
| 3,929,181 | 12/1975 | Beyer et al. | 164/114 |
| 3,954,133 | 5/1976 | Miyaoka et al. | 148/3 |

*Primary Examiner*—W. Stallard

[57] ABSTRACT

A technique for forming annular products such as bearing rings from a starting, centrifugally cast hollow ingot is described. The ingot is hot-sawed into intermediate annuli as it cools down from the casting temperature to below eutectoid temperature. The annuli are then soft-annealed to obtain a spheroidized carbidic phase, and are then re-heated to an austenization temperature. The re-heated annuli are then hot-worked by shape rolling or forging into the desired final shape, after which they are immediately quenched and tempered. The hot-working operation can proceed either above or below eutectoid temperature.

11 Claims, 4 Drawing Figures

PRODUCTION OF ANNULAR PRODUCTS FROM CENTRIFUGALLY CAST STEEL STRUCTURES

BACKGROUND OF THE INVENTION

The invention relates to a method for the formation of annular products from a hypereutectoid steel composition that has been initially centrifugally cast into an ingot in the form of a solid of revolution, illustratively a cylinder.

In known techniques for forming bearing rings and the like, a starting, centrifugally formed ingot is removed from the casting mold and pre-worked into tubular form. The resulting tube is then sawed into annuli having the width of the final product, and the annuli are subsequently worked by rolling, forging or upsetting prior to a finishing heat-treating operation.

Such techniques are advantageous in that they exhibit efficient utilization of the molten steel, particularly as a result of the fact that the centrifugal force brought into play during the casting operation tends to inhibit the formation of internal shrinkage cavities and segregates.

However, they have the disadvantage of requiring the expenditure of large quantities of heat for the casting, forming and heat-treating operations. In addition, the total time for processing of the product from the casting step through the final heat-treating operation is relatively long, principally due to the necessity of pre-working the ingot into a tube to be sawed.

SUMMARY OF THE INVENTION

Such disadvantages are overcome by the technique of the invention, which can be directly employed to form bearing rings or other finished annular products directly from a centrifugally cast starting structure of appropriate shape. In the method of the invention, the starting structure, generally in the form of a cylindrical hollow ingot, is initially cooled down from the casting temperature to below eutectoid. During the initial cooling step, the ingot is sawed into intermediate annuli, and the internal surfaces of the annuli are cleaned of slag and other impurities by appropriate machining operations.

After the initial cooling of the annuli, they are soft-annealed at a maximum temperature of 100° C above eutectoid temperature until a spheroidized carbidic phase is obtained. After this, the intermediates are re-heated to the austenization temperature, and are then hot-worked (as by shape rolling) to the finished shape. The hot-worked elements are then immediately quenched and tempered in preparation for a final machining operation, if desired.

The hot-working operation can proceed at approximately the austenization temperature above eutectoid temperature; alternatively, the re-heated elements can be initially cooled down to a temperature below eutectoid temperature at a rapid linear rate prior to hot-working. In the latter case, the warm-working temperature is maintained at a level higher than the temperature for the onset of martensite.

A principal advantage of the inventive method is that the heat supplied during the course of the melting operation can be efficiently utilized for the subsequent operations carried out at elevated temperatures. In addition, significant savings in material, labor and time result from the fact that no pre-working of the cast ingot into tubular form is necessary. Additionally, the hot-working operations carried on on the intermediate product of the invention require much less machining than the products obtained by prior similar processes.

BRIEF DESCRIPTION OF THE DRAWING

The technique of the invention is further elaborated in the following detailed description taken in conjunction with the appended drawing, in which.

DETAILED DESCRIPTION

Figure 1:
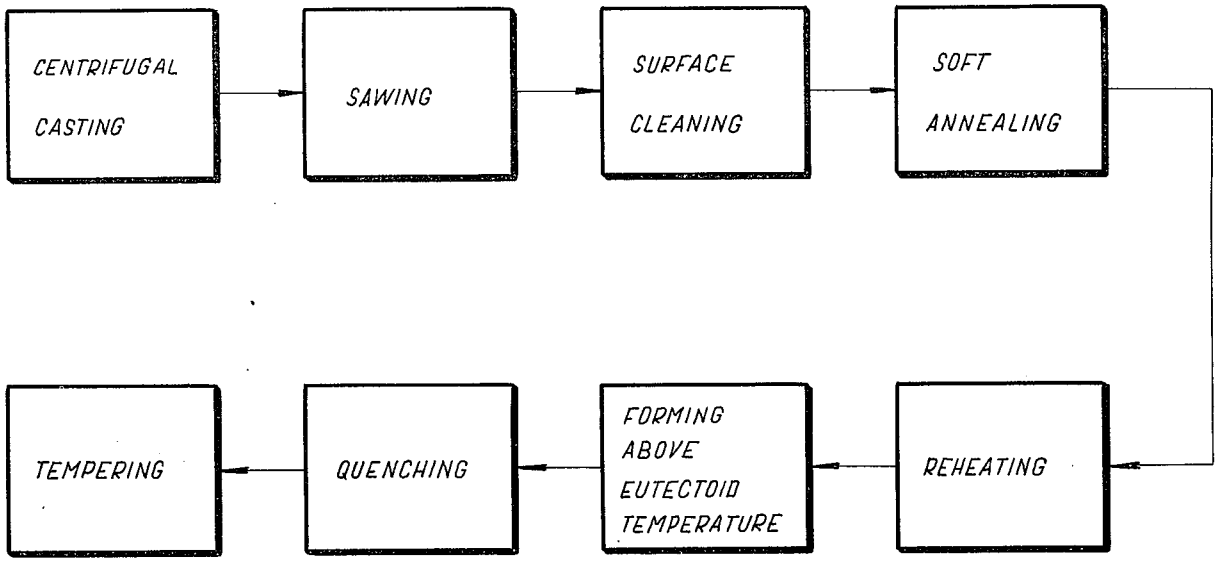
FIG. 1 is a flow diagram illustrating a first technique in accordance with the invention for the formation of finished annular products by the direct processing of a centrifugally cast starting ingot.

Referring now to the flow diagram of FIG. 1, an illustrative technique for carrying out the method of the invention is depicted. A hypereutectoid steel composition, which has illustratively been formed in a fluidization furnace, is centrifugally cast into an ingot in the shape of a solid of revolution, illustratively a hollow cylinder. While the cast ingot is cooling down toward the eutectoid temperature of the steel composition, it is divided into a plurality of annular intermediates, as by rotary sawing. During the same initial cooling step, the internal surfaces of the sawed intermediates are cleaned of the slag and other impurities which had been driven out of the interior of the ingot during the casting operation; such surface cleaning may be accomplished by conventional machining.

Figure 2:
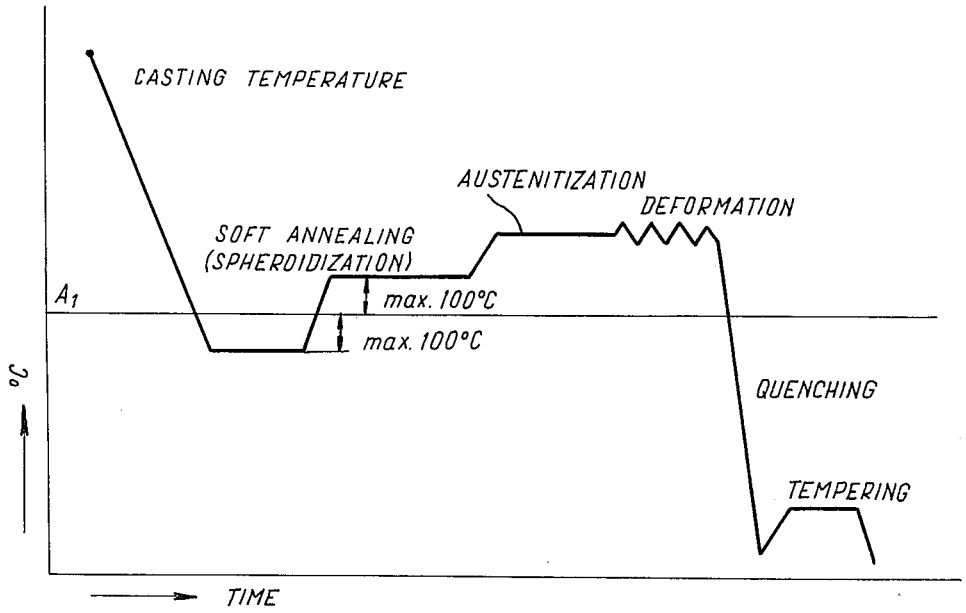
FIG. 2 is a temperature-time curve illustrating the various operations in the technique represented by the flow diagram of FIG. 1.

When the intermediates have been initially cooled down to a prescribed temperature below eutectoid temperature (such eutectoid temperature being represented by the value $A_1$ in FIG. 2), they are subjected to a soft-annealing operation. The point of termination of the initial cooling step is a temperature of 100° C maximum below $A_1$. The soft-annealing step is accomplished at a maximum temperture of 100° C above $A_1$, and proceeds until the resulting carbidic phase exhibits spheroidization.

After such spheroidization has been attained, the intermediates are re-heated above eutectoid to a maximum temperature of 1150° C to form austenite, after which the intermediates are hot-worked at approximately the austenitization temperature to deform them into the shape of the finished annular products. The so-formed intermediates are then immediately quenched to below the temperature corresponding to the onset of the martensite phase, after which they are suitably tempered to complete the heat treatment process.

Figure 4:
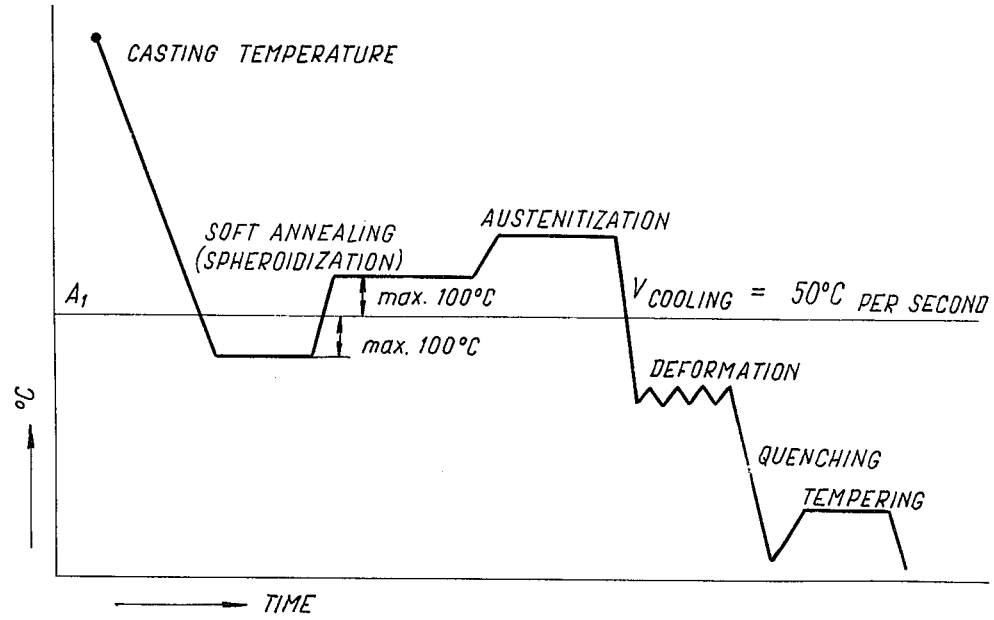
FIG. 4 is a temperature-time curve illustrating the various steps represented by the flow diagram of FIG. 3.
Figure 3:
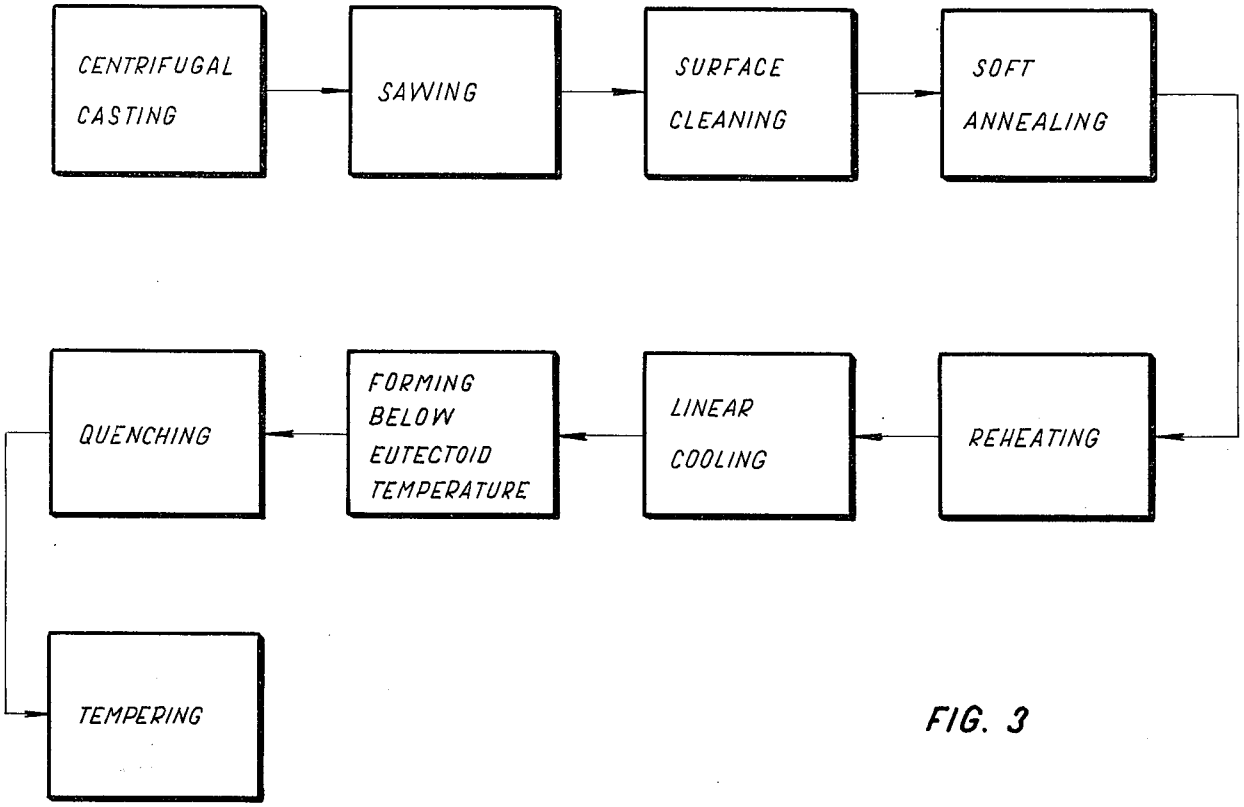
FIG. 3 is a flow diagram, similar to FIG. 1, indicating a modification of the technique of FIG. 1 wherein the hot-working step is accomplished below the eutectoid temperature.

In the alternate technique of the invention indicated in FIGS. 3–4, the warm-working step is accomplished below the eutectoid temperature $A_1$ by subjecting the austenitized intermediates to a rapid, linear cooling step of at least 50° C per second. The hot-working, quenching and tempering steps then proceed in the general manner indicated in FIGS. 1–2.

Without in any way limiting the generality of the foregoing, the following example is presented to further illustrate the inventive technique.

EXAMPLE

The starting material was a hypereutectoid steel composition containing, as additives, 0.7–0.8% by weight of carbon, 2% by weight of manganese, 2% by weight of silicon, 1% by weight of chromium, and 0.03 combined percent by weight of sulfur and phosphorus. Such composition, prepared in molten form in an electric arc furnace, was initially cast into a horizontally disposed ingot mold which was rotated at a rate of 800 turns per minute. The geometry and size of the mold were chosen so that the resulting ingot had an external diameter of about 380 mm, a length of 4400 mm, and a weight of about 3 metric tons.

While the cast ingot was cooling down, it was divided with the aid of a rotating saw into 24 ring-shaped intermediates, whose surfaces were cleaned during the cooling of the intermediates to below the eutectoid temperature by a machining operation to remove the accumulated slag. The so-cooled rings were then soft-annealed by heating to about 760° C to produce a spheroidization of the perlitic structure. Such spheroidized rings were then re-heated to 820° C, and while at that temperature were supported on a mandrel and rolled between the mandrel and a rolling disc to form finished rings suitable for use as heavy-duty bearing rings. The temperature of the finished rings after the hot-working operation was about 800° C. The rings were then immediately quenched in an oil bath, followed by a tempering operation for 3 hours at 170° C to complete the heat-processing portion of the operation.

It was found that bearing rings of the type and size illustrated in the example could be produced by the technique of the invention at considerable savings relative to prior-art processes. Illustratively, the elimination of the previous pre-working of the ingot into a tube, and the various operations incident thereto, yielded a significant time saving. Also, the required quantity of molten ingot steel was considerably reduced, while the properties of the resulting finished bearing rings were enhanced.

In the foregoing, an illustrative technique of the invention has been described. Many variations and modifications will now occur to those skilled in the art. For example, while the inventive technique is particularly useful in the manufacture of bearing rings, it is equally applicable to many other kinds of annular products, such as vehicle wheels, gear blanks and the like. It is accordingly desired that the scope of the appended claims not be limited to the specific disclosure herein contained.

What is claimed is:

1. In a method of forming annular products from a hypereutectoid steel composition which has been initially centrifugally cast into a hollow ingot having the shape of a solid of revolution, the steps of initially cooling the just-cast ingot from the casting temperature to a temperature below the eutectoid temperature of the steel composition, directly dividing the ingot into a plurality of intermediate annuli during the initial cooling step, soft-annealing the resulting intermediates at a prescribed temperature above the eutectoid temperature to obtain a spheroidized carbidic phase, re-heating the soft-annealed intermediates to a temperature in the austenitization range, and hot-working the re-heated intermediates into the form of the final product.

2. A method as defined in claim 1, in which the initial cooling step is terminated when the ingot reaches a minimum temperature of 100° C below the eutectoid temperature.

3. A method as defined in claim 1, in which the soft-annealing step is carried out at a maximum temperature of 100° C above the eutectoid temperature.

4. A method as defined in claim 1, in which the re-heated intermediate is linearly cooled down to a prescribed temperature below the eutectoid temperature prior to the hot-working step.

5. A method as defined in claim 4, in which the linear cooling step is accomplished at a rate of approximately 50° C per second.

6. A method as defined in claim 4, in which the prescribed temperature below the eutectoid temperature is above the temperature of martensite formation.

7. A method as defined in claim 1, in which the hot-working step is accomplished at a temperature above the eutectoid temperature.

8. A method as defined in claim 7, in which the maximum temperature of the hot-working step is 1150° C.

9. A method as defined in claim 1, in which the method comprises the further step of cleaning impurities from the surface of the intermediates during the initial cooling step.

10. A method as defined in claim 1, in which the method comprises the further steps of quenching the hot-worked annuli, and tempering the quenched annuli.

11. In a method of forming annular products from a centrifugally cast hypereutectoid steel having the shape of a solid of revolution, the steps of initially cooling the just-cast structure to a temperature lower than the eutectoid temperature of the steel composition by an amount not greater than 100° C, soft-annealing the initially cooled structure at a temperature which exceeds the eutectoid temperature by not more than 100° C to yield a spheroidized carbidic phase, re-heating the soft-annealed structure to a maximum temperature of 1150° C, and hot-working the re-heated structure into finished annular form.

* * * * *